US006280104B1

(12) United States Patent
Müller et al.

(10) Patent No.: US 6,280,104 B1
(45) Date of Patent: Aug. 28, 2001

(54) CONFIGURATION FOR DEPOSITING RECORDING MEDIA

(75) Inventors: Dietrich Müller; Wolfgang Von Inten, both of Berlin (DE)

(73) Assignee: Francotyp-Postalia AG & Co., Birkenwerder (DE)

( * ) Notice: Subject to any disclaimer, the term of this patent is extended or adjusted under 35 U.S.C. 154(b) by 0 days.

(21) Appl. No.: 09/477,889

(22) Filed: Jan. 5, 2000

(30) Foreign Application Priority Data

Jan. 5, 1999 (DE) ..... 199 00 687

(51) Int. Cl.[7] ..... B41J 11/06; B65H 29/00
(52) U.S. Cl. ..... 400/48; 101/91; 271/185
(58) Field of Search ..... 400/48, 635; 101/91; 271/185, 224; 705/406; 347/23; 414/798.2

(56) References Cited

U.S. PATENT DOCUMENTS

| | | | | |
|---|---|---|---|---|
| 3,918,703 | | 11/1975 | Mano et al. . | |
| 4,561,352 | * | 12/1985 | Svyatsky et al. | 400/48 |
| 5,122,962 | * | 6/1992 | Gilham | 705/406 |
| 5,332,210 | * | 7/1994 | Silverberg | 271/224 |
| 5,340,948 | * | 8/1994 | Ramsden | 705/406 |
| 5,368,287 | * | 11/1994 | Belec | 271/185 |
| 5,464,317 | * | 11/1995 | Foster et al. | 414/798.2 |
| 5,794,222 | * | 8/1998 | Wakabayashi et al. | 705/406 |
| 5,996,664 | * | 12/1999 | Gregoire | 705/406 |
| 6,041,569 | * | 3/2000 | Freeman et al. | 705/406 |
| 6,041,704 | * | 3/2000 | Pauschinger | 101/91 |
| 6,045,278 | * | 4/2000 | Kubatzki et al. | 400/635 |
| 6,086,182 | * | 7/2000 | Nambudiri | 347/23 |
| 6,178,410 | * | 1/2001 | Kunde et al. | 705/406 |

FOREIGN PATENT DOCUMENTS

| | | |
|---|---|---|
| 196 05 014 C1 | 3/1997 | (DE) . |
| 196 05 015 C1 | 3/1997 | (DE) . |
| 197 05 089 C1 | 3/1998 | (DE) . |
| 197 42 893 A1 | 4/1999 | (DE) . |

* cited by examiner

*Primary Examiner*—Eugene Eickholt
(74) *Attorney, Agent, or Firm*—Herbert L. Lerner; Laurence A. Greenberg; Werner H. Stemer

(57) ABSTRACT

A configuration for depositing media, particularly envelopes, transported in a franking and/or addressing machine standing on edge and butting against an inclined guide plate. The configuration is disposed downstream of the franking machine and includes a single-piece insert laterally attached and releasably coupled to the franking machine and an angled depositing box. A depositing box front wall is laterally and slidably coupled to the insert through a slit. The insert has a channel to receive recording media travelling on edge from the franking machine. The channel has a nose at an upstream end and formed as a slanting plane sloping downward in the travelling direction and projecting beyond a side of the insert and into the franking machine guide plane, and a supporting plate at an upstream end and a rear region adapted to a guide plate inclination. The depositing box has three slopes having a wedge-shaped cross-section that is bent on one side and defining a depositing region. The channel adjoins a franking machine guide plane, runs horizontally and slightly obliquely rearward behind an abutment plane of a guide plate, and undercuts such that the depositing region extends beneath the channel. The rear side of the insert undercuts the channel. The configuration permits recording media to be deposited in a careful and functionally reliable manner.

12 Claims, 6 Drawing Sheets

CONFIGURATION FOR DEPOSITING RECORDING MEDIA

BACKGROUND OF THE INVENTION

Field of the Invention

The invention relates to a configuration for depositing recording media, in particular envelopes or letters, which are discharged from a franking and/or addressing machine standing on one edge.

In the case of the franking and/or addressing machines that have been available on the market up until now, the envelopes or letters are transported horizontally and usually after being printed, and, as a result of the kinetic energy that still prevails, pass into a downstream box. The envelopes or letters are deposited one above the other in the box.

Also in the prior art is a franking machine in which the envelopes or letters are transported standing on one edge and butting against a rearwardly inclined guide plate. See German Application Numbers DE 19 605 014 and DE 19 605 015. Proposals have been made for a configuration for depositing envelopes or letters for a franking machine (see German Patent Application DE 197 42 893.2, which has not been previously published), in which an insert is releasably connected to the machine, and the envelopes or letters slide from the insert into a shallow box and are deposited horizontally one above the other. See, for example, FIG. 1. In FIG. 1, the insert 2 is angled and includes a front wall 21 and a side wall 22. The two walls 21, 22 are orthogonal with respect to one an other and the side wall 22 is attached to the franking machine 1. The front wall 21 has a channel 211 for the bottom edge of the envelopes or letters in the franking machine 1. The channel 211 slopes down in the transporting direction and adjoins the guide plan e 121. The outlet part of the guide plane 121 is configured, analogously to the channel 211, in a downward slope.

A depositing box 3 formed as an angled part that can be adjusted with respect to the insert 2 is provided in conjunction with the insert 2. The depositing box 3 includes a front wall 31, a side wall 32, and a base plate 33. The walls 31, 32, 33 are disposed orthogonally with respect to one another. As such, the base plate 33 serves as a carrier for the envelopes or letters deposited. The front wall 31 is guided adjustably in an adapted slit 212 of the front wall 21 of the insert 2. The side wall 32 is configured as a resilient deflecting wall and is disposed orthogonally with respect to the envelope-transporting direction and at an adjustable distance downstream of the channel 211. The distance is usually selected to be somewhat greater than the largest envelope or letter format that is to be processed.

Because the envelope or letter stack also acts as a tipping edge, the FIG. 1 configuration achieves a stacking height corresponding approximately to half the height of the smallest envelope or letter format and/or the height of the central part of the channel 211.

Furthermore, proposals have been made for applying an apparatus for transferring envelopes or letters to a downstream depositing apparatus of the type described immediately above to the first above-mentioned franking machine. See German Patent Number 198 40 917 C1 and FIGS. 2 and 2*a*. In FIGS. 2 and 2*a*, a driven transporting roller 14 is provided in a franking machine 1 immediately downstream of the transporting belt 12 in an envelope-transporting direction and at the same height as the transporting belt 12. The circumferential speed of the transporting roller 14 is adjusted to be higher than the speed of the transporting belt 12. The sliding surface 121 following the transporting roller 14 for the bottom edge of the envelopes or letters is at a lower level and has a sliding configuration. The inclination and shape of the sliding surface 121 and the initial region 2111 of channel 211 are adapted to one another.

In the above-described examples, there is a risk that newly closed envelopes deposited spring open, particularly when thick envelopes or letters are deposited. Furthermore, the stack itself limits the stacking height.

SUMMARY OF THE INVENTION

It is accordingly an object of the invention to provide a configuration for depositing recording media that overcomes the hereinafore-mentioned disadvantages of the heretofore-known devices of this general type and that improves the reliability and the usability of the franking and/or addressing machine.

The object of the invention is to provide a configuration by which recording media, particularly envelopes or letters, can be deposited in a careful and functionally reliable manner and the stacking height is determined merely by the configuration itself.

With the foregoing and other objects in view, there is provided, in accordance with the invention, a configuration for depositing recording media that are transported in a franking and/or addressing machine standing on one edge and butting against an inclined guide plate of the machine, the machine having a guide plane and the guide plate having an abutment plane, the configuration including a single-piece insert laterally attached to the machine and being formed with a channel for receiving recording media travelling on edge from the machine and for sliding recording media thereon, and a depositing box having a depositing region and cooperating with the insert, the channel adjoining a guide plane of the machine, running horizontally and slightly obliquely rearward behind an abutment plane of a guide plate of the machine, and undercut such that the depositing region extends beneath the channel.

Since the channel, on one hand, runs horizontally and, on the other hand, extends obliquely behind the guide plane of the guide plate of the franking machine, the envelopes or letters are braked and tipped immediately after leaving the franking machine. Such influence avoids forcible impact against the side wall of the depositing box.

In accordance with another feature of the invention, the franking machine has a transporting roller preceding the channel in a recording media travelling direction, the transporting roller terminates flush with the guide plane, the insert has a front wall with a rear side, and the channel slopes downward and is formed in the front wall of the insert such that the rear side of the front wall undercuts the channel.

In accordance with a further feature of the invention, the insert has an upstream side in a recording media travelling direction, and the channel has an upstream end in the recording media travelling direction, a rear region in a viewing direction of the machine, a nose at the upstream end and formed as a slanting plane sloping downward in the recording media travelling direction and projecting beyond the upstream side of the insert and into the guide plane of the machine, a supporting plate at the upstream end and at the rear region that is adapted to an inclination of the guide plate of the machine, a front top guide slope, a front bottom guide slope, and a rear guide slope, the three guide slopes having, in a transverse profile, a wedge-shaped depression that is bent on one side.

The maximum stacking height of the envelopes or letters is determined by that height of the rear top edge of the channel above the base of the depositing box. The nose, upstream of the channel, which projects into the sliding surface of the franking machine achieves a smooth transition for the envelopes or letters to the channel without the risk of catching.

In addition to the guide channel, the configuration of the rear side of the front wall of the insert according to the invention has considerable influence. Because the rear side of the front wall undercuts the channel, the tipped envelope or letter has sufficient free space to come into contact at an oblique angle with the base of the depositing box or a previously deposited envelope or letter. Moreover, the rear side is also included in the dropping operation insofar as the envelope or letter slides downward with the previously load-bearing edge butting against the rear side. The rear side of the insert and the side wall of the depositing box prevent the envelope or letter from turning out to the side and to the front.

In accordance with an added feature of the invention, the insert is made from plastic, preferably, acrylonitrile-butadiene-styrene.

In accordance with yet another feature of the invention, the depositing box is angled and is slidably adjustable to the insert.

In accordance with yet a further feature of the invention, the insert has a front wall with a slit, and the depositing box includes a front wall, a side wall, and a base plate that are disposed orthogonal to one another, the base plate is a carrier for recording media deposited in the depositing box, the side wall is orthogonal to recording media travelling direction and downstream of the channel in a recording media travelling direction, the front wall is formed to be guided in the slit such that a distance between the side wall and the machine can be adjusted.

In accordance with yet an added feature of the invention, the distance between the side wall and the machine can be adjusted to be at least as large as a largest recording media format that is to be processed by the machine.

In accordance with yet an additional feature of the invention, the depositing box is corrosion-resistant, preferably corrosion-resistant metal or corrosion-resistant plastic.

In accordance with a concomitant feature of the invention, there is provided a configuration for depositing envelopes that are transported in a franking machine standing on one edge and butting against an inclined guide plate of the franking machine, the franking machine having a guide plane and the guide plate having an abutment plane, the configuration including a single-piece insert laterally attached to a franking machine and being formed with a channel for receiving an envelope travelling on edge from the franking machine and for sliding the envelope thereon, and a depositing box having a depositing region and cooperating with the insert, the channel adjoining a guide plane of the franking machine, running horizontally and obliquely rearward behind an abutment plane of a guide plate of the franking machine, and undercut such that the depositing region extends beneath the channel.

Other features that are considered as characteristic for the invention are set forth in the appended claims.

Although the invention is illustrated and described herein as embodied in a configuration for depositing recording media, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
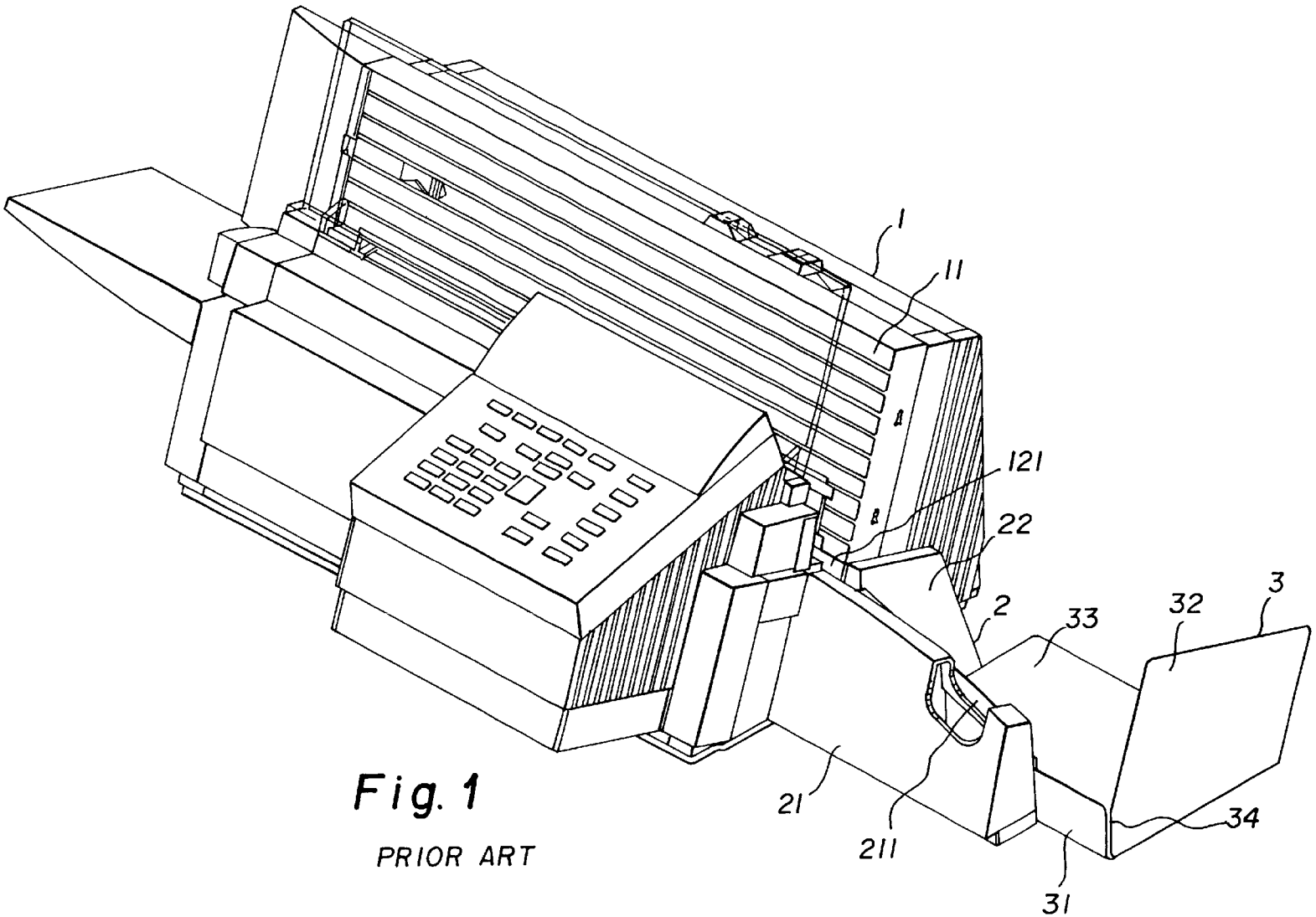
Fig. 1 PRIOR ART
FIG. 1 is a diagrammatic, perspective frontal view of the franking machine with an envelope or letter depositing configuration according to German Patent Application No. 197 42 893.2.
Figure 2A:
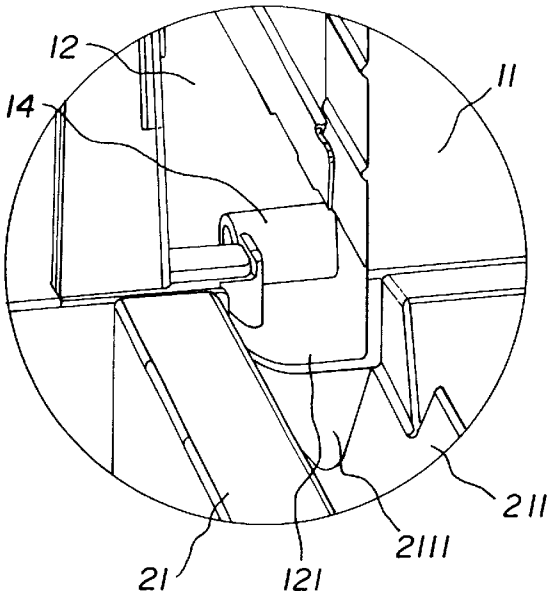
Fig. 2a PRIOR ART
FIGS. 2 and 2*a* is a diagrammatic, perspective side view and a partly magnified partial view of the franking machine having an envelope or letter transferring apparatus according to German Patent No. 198 40 917 C1.
Figure 2:
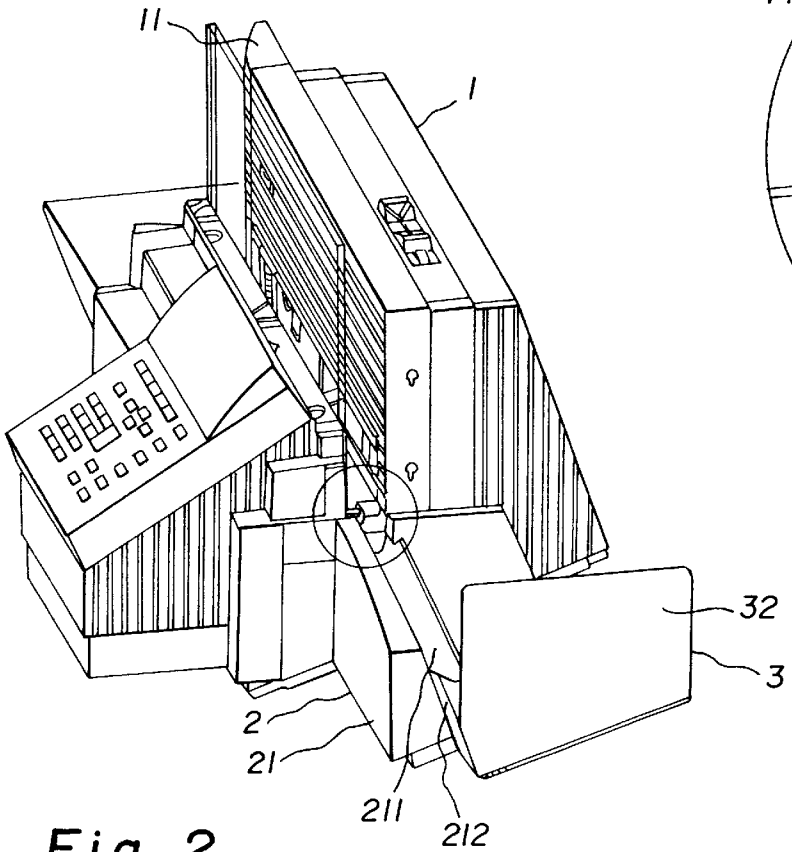
Fig. 2 PRIOR ART

In all the figures of the drawing, sub-features and integral parts that correspond to one another bear the same reference symbol in each case.

Figure 3:
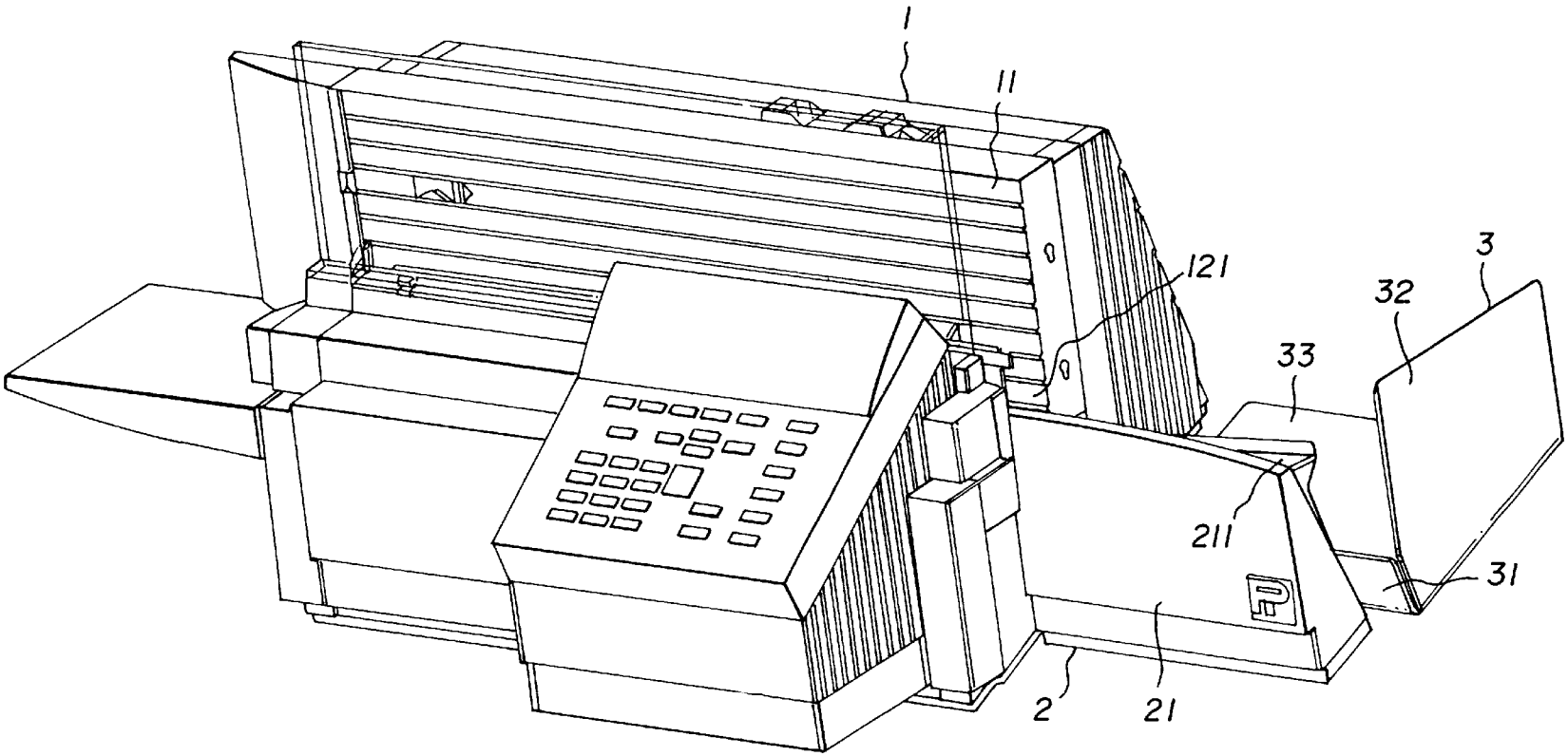
FIG. 3 is a diagrammatic, perspective frontal view of a machine configuration for depositing recording media according to the invention.

Referring now to the figures of the drawings in detail and first, particularly to FIG. 3 thereof, there is shown the depositing configuration according to the invention. In order to simplify matters and to aid understanding, the illustration is in schematic form. Further, the term franking machine, as it is used herein and in the following claims, connotes any device for imprinting or for depositing recording media such as letters, envelopes, cards, or the like, including franking machines, addressing machines, advertising imprinting machines, and the like.

Figure 4:
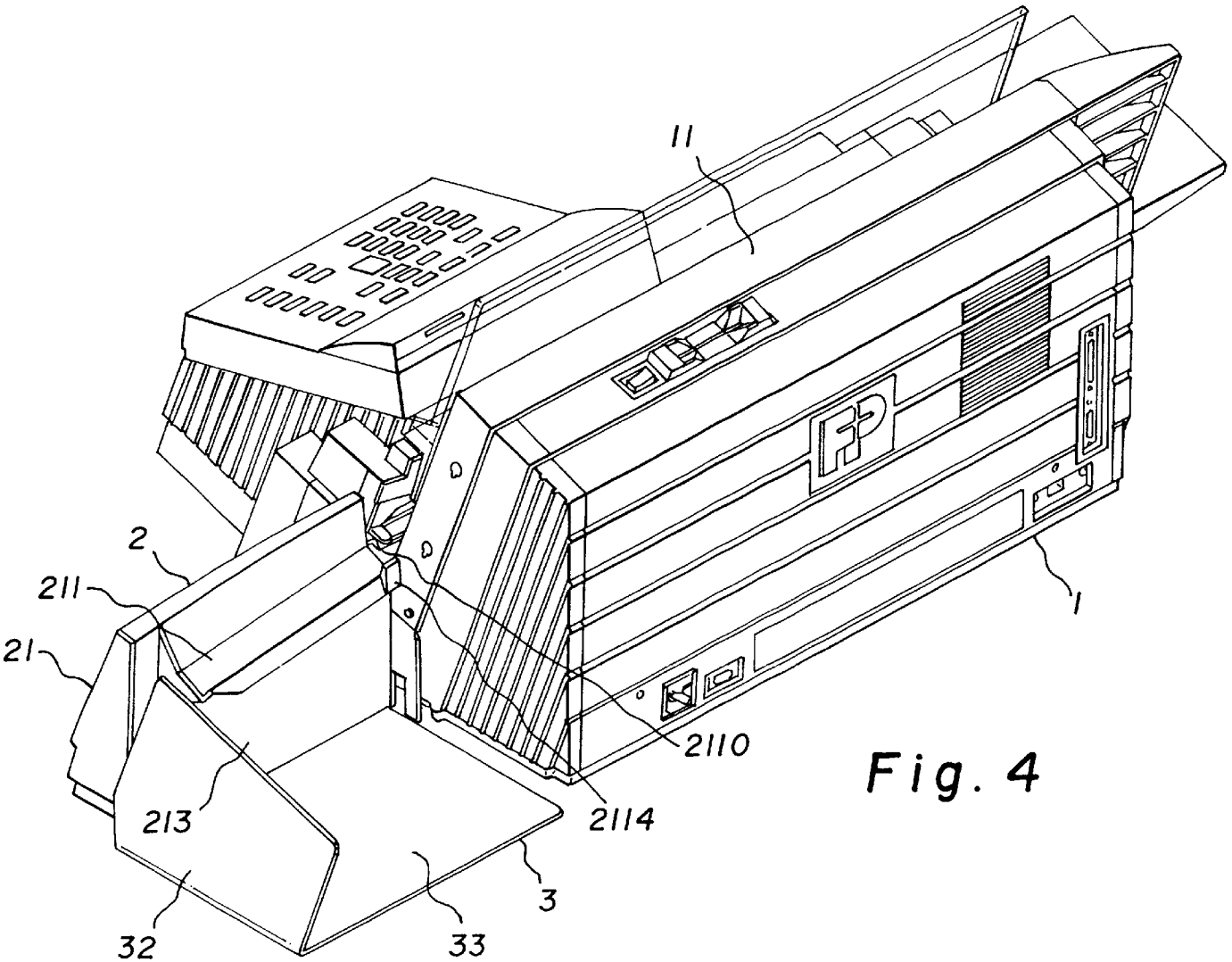
FIG. 4 is a diagrammatic, perspective rear view of the configuration according to FIG. 3.
Figure 5B:
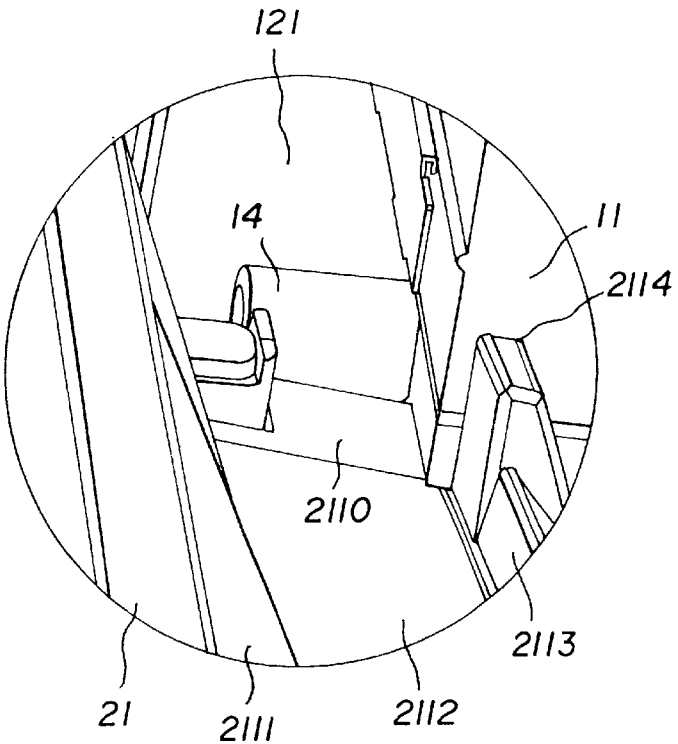
FIGS. 5 and 5*a* is a diagrammatic, perspective side view of the configuration according to FIG. 3 with a partly magnified partial view.
Figure 5A:
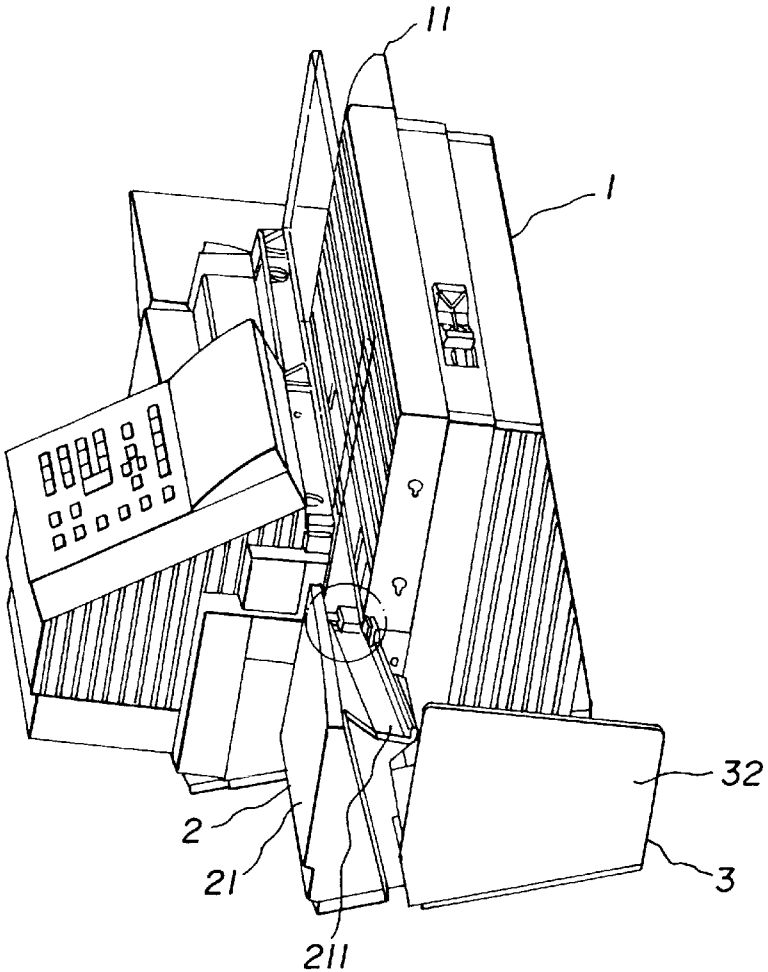

The configuration according to the invention includes an insert 2 coupled to the franking machine 1 and a depositing box 3 connected to the insert 2. The insert 2 is configured as a single-piece part. A horizontally, obliquely, rearwardly running channel 211 is formed in the front wall 21. Other views of the insert 2 are shown in FIGS. 4, 5 and 5*a*.

The angled depositing box 3 has a front wall 31, a side wall 32 and a base plate 33 orthogonal with respect to one another. The depositing box 3 is guided by its front wall 31 into the front wall 21 of the insert 2 in a slit 212 of the insert 2 (see FIG. 6*a*) such that the depositing box 3 can be adjusted into and out of the transporting direction. Such slidability allows the distance between the side wall 32 and the outlet of the franking machine 1 to be adjusted to the largest recording media size, i.e., envelope or letter format, that is to be processed at any given time.

The recording media 5 (see FIGS. 6*a* and 6*b*) is conveyed in the franking machine 1 standing on one edge by a transporting belt 12 such that it slides along a slightly rearwardly inclined guide plate 11. The recording media 5 is pushed onto the channel 211 on the outlet side of the franking machine 1 by a driven transporting roller 14 disposed flush in the guide plane 121. The run-out part of the guide plane 121 has a downwardly sloping configuration. See the magnified view of FIG. 5*a*.

One embodiment of the invention has the recording media 5, during transportation in the franking machine 1, standing on a non-illustrated transporting belt 12 or on a short leg of the guide plate 11. Accordingly, the guide plane 121 for the bottom edge of a recording media 5 is formed either by the top surface of the transporting belt 12 and a downstream sliding element 121 or by the surface of the short leg of the guide plate 11.

The insert 2 can be made from plastic, preferably from acrylonitrile-butadiene-styrene.

The depositing box 3 has an advantageously corrosion-resistant configuration, for example, it is made from a rust-resistant metal or from a metal-plated plastic, i.e., matt hard-chrome-plated.

The channel 211 runs horizontally in adaptation to the plane 121 on which the recording media 5 stands while in the franking machine 1.

According to FIGS. 4, 5 and 5*a*, the channel 211 runs horizontally overall, but slopes slightly rearwardly in the transporting direction behind the front plane of the guide plate 11.

Due to the guide plate 11 inclination, the recording media 5 has a clearly predetermined orientation which ensures that the recording media 5 is deposited in the direction of the depositing box 3. See also the explanation related to FIG. 6 below.

Recording media 5 are stacked one above the other on the base plate 33 of the depositing box 3. The right-hand side wall 32 (viewed from the front of the franking machine) prevents the recording media 5 from moving out laterally. The front wall 31 of the depositing box 3 is guided in the slit 212 of the front wall 21 of the insert 2 (see FIG. 6*a*) such that it can be adjusted in accordance with the largest recording media format that is to be processed.

The channel 211 has, at the start, a nose 2110 which projects beyond the side of the insert 2 into the downwardly sloping region of the franking machine 1. The nose 2110 is configured as a slanting plane that slopes down in the outward direction, in order to prevent, for example, an envelope or letter 5 from catching during transfer to the channel 211. The channel 211 also has, at the start of the channel 211 and at the rear region of the channel 211 (viewed from the front of the franking machine 1), a supporting plate 2114 which is adapted to the inclination of the guide plate 11 in the franking machine 1. The supporting plate 2114 prevents thin, lightweight recording media from fluttering about, which could cause incorrect recording media deposition. See also FIG. 6*a*.

The channel 211 has a front top guide slope 2111, a front bottom guide slope 2112 and a rear guide slope 2113. The guide slopes 2111, 2112, 2113 provide, in transverse profile, a wedge-shaped depression bent on one side. Thus, recording media 5 running into the channel 211 slides down to the base of the guide slopes 2111, 2112, 2113 to the extent permitted by the thickness of the edge of the recording media that is being placed in position.

Figure 6A:
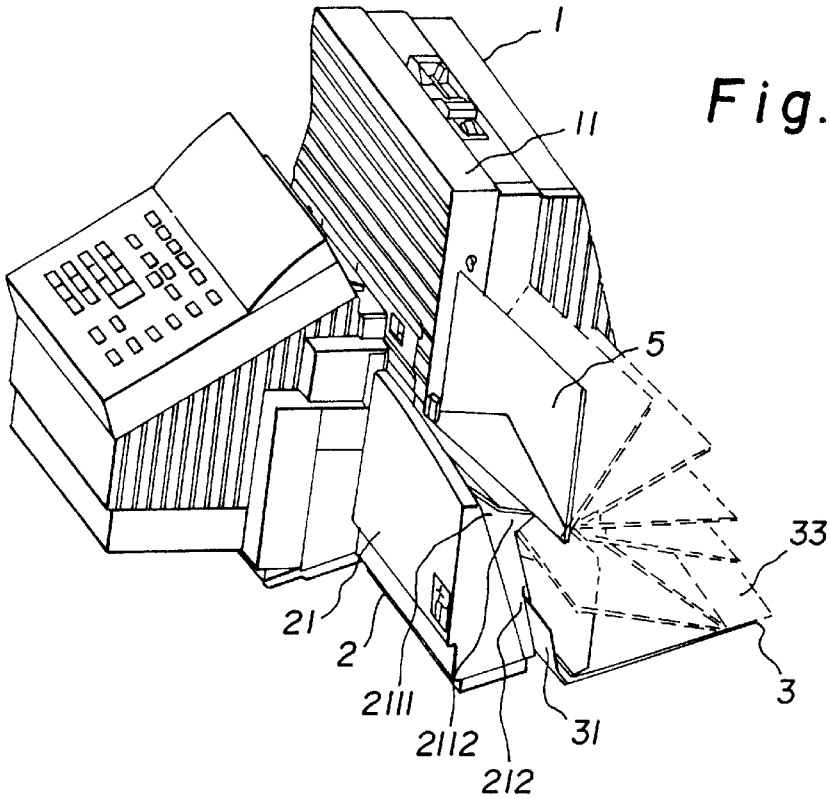
FIG. 6*a* is a diagrammatic, perspective frontal side view of the configuration according to FIG. 3 showing details relating to depositing of recording media.
Figure 6B:
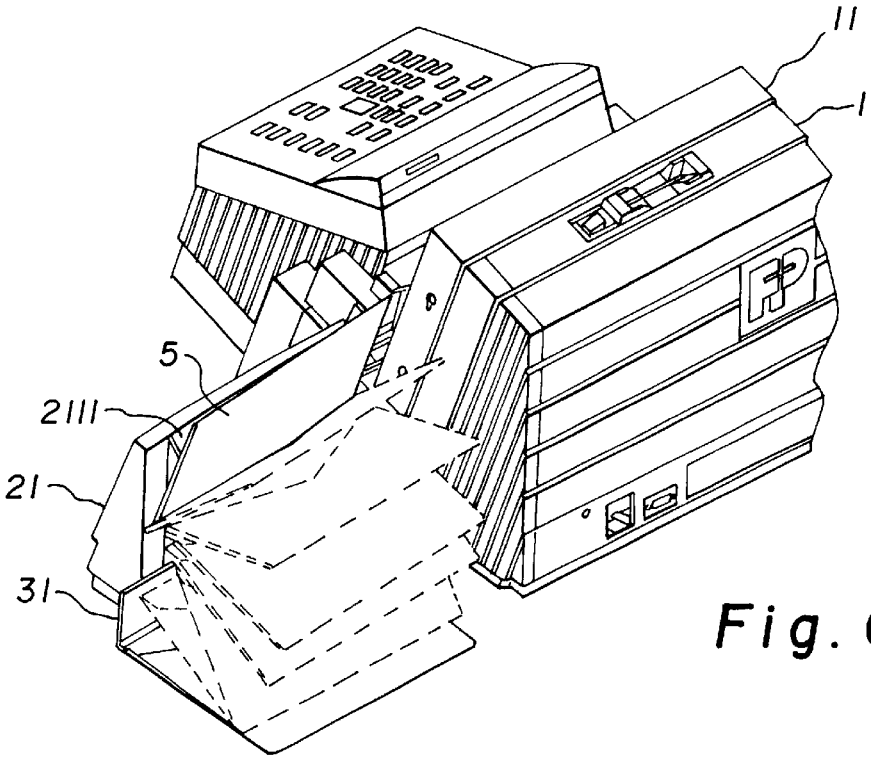
FIG. 6*b* is a diagrammatic, perspective rear side view of the configuration according to FIG. 6*a*.

FIGS. 6*a* and 6*b* illustrate in more detail the movement sequence of the recording media 5, particularly an envelope, as it is deposited from the insert 2 into the depositing box 3. Envelopes 5 having dashed lines define the movement sequence. The configuration of the channel 211 and of the rear side 213 of the front wall 21 particularly influences the movement. The rear side 213 of the front wall 21 undercuts the channel 211 and/or the rear guide slope 2113. See FIG. 4.

When the entire envelope 5 has left the franking machine 1, it first tips from the rear guide slope 2113 such that the envelope 5 edge that is located opposite the envelope flap comes into contact at an oblique angle with the base plate 33 of the depositing box 3 or with a side of a previously deposited envelope S. The envelope 5 then slides downward with the envelope flap edge on the rear side 213 of the front wall 21. In this way, the envelope 5 slides into the depositing box 3 and avoids impact loading. Depositing becomes smoother as the stacking height increases.

Due to the horizontal progression of the channel 211, the recording media 5 is horizontally guided into the channel 211 and merely tips by the top edge of the rear guide slope 2113.

Accordingly, it is possible to have at least a stacking height for recording media 5 that corresponds to the height of the top edge of the rear guide slope 2113.

We claim:

1. A configuration for depositing recording media that are transported in a franking machine standing on one edge and butting against an inclined guide plate of the franking machine, the franking machine having a guide plane and the guide plate having an abutment plane, the configuration comprising:

a single-piece insert laterally attached to a franking machine and being formed with a channel for receiving recording media travelling on edge from the franking machine and for sliding recording media thereon; and a depositing box having a depositing region and cooperating with said insert, said channel adjoining a guide plane of the franking machine, running horizontally and obliquely rearward behind an abutment plane of a guide plate of the franking machine, and undercut such that said depositing region extends beneath said channel.

2. The configuration according to claim 1, wherein the franking machine has a transporting roller preceding said channel in a recording media travelling direction, the transporting roller terminates flush with the guide plane, said insert has a front wall with a rear side, and said channel slopes downward and is formed in said front wall of said insert such that said rear side of said front wall undercuts said channel.

3. The configuration according to claim 2, wherein said insert has an upstream side in a recording media travelling direction, and said channel has:

an upstream end in the recording media travelling direction;

a rear region in a viewing direction of the franking machine;

a nose at said upstream end and formed as a slanting plane sloping downward in the recording media travelling direction and projecting beyond said upstream side of said insert and into the guide plane of the franking machine;

a supporting plate at said upstream end and at said rear region that is adapted to an inclination of the guide plate of the franking machine;

a front top guide slope;

a front bottom guide slope; and a rear guide slope, said front top guide slope, said front bottom guide slope, and said rear guide slope having, in a transverse profile, a wedge-shaped depression that is bent on one side.

4. The configuration according to claim 1, wherein said insert is made from plastic.

5. The configuration according to claim 4, wherein said plastic is acrylonitrile-butadiene-styrene.

6. The configuration according to claim 1, wherein said depositing box is angled and is slidably adjustable to said insert.

7. The configuration according to claim 1, wherein said insert has a front wall with a slit, and said depositing box includes a front wall, a side wall, and a base plate that are disposed orthogonal to one another, said base plate is a carrier for recording media deposited in said depositing box, said side wall is orthogonal to a recording media travelling direction and downstream of said channel in a recording media travelling direction, said front wall is formed to be guided in said slit such that a distance between said side wall and the franking machine can be adjusted.

8. The configuration according to claim 7, wherein the distance between said side wall and the franking machine can be adjusted to be at least as large as a largest recording media format that is to be processed by the franking machine.

9. The configuration according to claim 1, wherein said depositing box is corrosion-resistant.

10. The configuration according to claim 1, wherein said depositing box is corrosion-resistant metal.

11. The configuration according to claim 1, wherein said depositing box is corrosion-resistant plastic.

12. A configuration for depositing envelopes that are transported in a franking machine standing on one edge and butting against an inclined guide plate of the franking machine, the franking machine having a guide plane and the guide plate having an abutment plane, the configuration comprising:

a single-piece insert laterally attached to a franking machine and being formed with a channel for receiving an envelope travelling on edge from the franking machine and for sliding the envelope thereon; and a depositing box having a depositing region and cooperating with said insert, said channel adjoining a guide plane of the franking machine, running horizontally and obliquely rearward behind an abutment plane of a guide plate of the franking machine, and undercut such that said depositing region extends beneath said channel.

* * * * *